US005957679A

United States Patent [19]

Cacciatore

[11] Patent Number: 5,957,679

[45] Date of Patent: Sep. 28, 1999

[54] GAS FIREPLACE BURNER CONTROL SYSTEM

[75] Inventor: Joseph J. Cacciatore, Woodridge, Ill.

[73] Assignee: Harper-Wyman Company, Aurora, Ill.

[21] Appl. No.: 08/898,186

[22] Filed: Jul. 22, 1997

[51] Int. Cl.[6] ..... F23N 5/24

[52] U.S. Cl. ..... 431/18; 431/24; 431/73; 431/78; 126/502

[58] Field of Search ..... 431/18, 75, 73, 431/77, 78, 24, 25, 27; 126/502, 512

[56] References Cited

U.S. PATENT DOCUMENTS

| | | | |
|---|---|---|---|
| 3,142,332 | 7/1964 | Weber et al. | 431/18 |
| 3,270,800 | 9/1966 | Deziel et al. . | |
| 3,384,439 | 5/1968 | Walbridge . | |
| 3,574,496 | 4/1971 | Hewitt . | |
| 3,832,123 | 8/1974 | Walbridge . | |
| 3,853,455 | 12/1974 | Riordan et al. . | |
| 3,861,854 | 1/1975 | Walbridge . | |
| 3,963,410 | 6/1976 | Baysinger . | |
| 4,019,854 | 4/1977 | Carlson et al. . | |
| 4,087,229 | 5/1978 | Teichert et al. | 431/25 |
| 4,106,889 | 8/1978 | Katchka | 431/46 |
| 4,125,357 | 11/1978 | Kristen et al. | 431/78 |
| 4,289,476 | 9/1981 | Visos et al. . | |
| 4,405,299 | 9/1983 | Serber | 431/78 |
| 4,622,005 | 11/1986 | Kuroda | 431/78 |
| 4,652,231 | 3/1987 | Berlincourt | 431/78 |
| 4,865,539 | 9/1989 | Geary | 431/75 |
| 5,127,823 | 7/1992 | Bonner . | |
| 5,169,303 | 12/1992 | Paluck . | |
| 5,636,978 | 6/1997 | Sasaki | 431/18 |
| 5,722,823 | 3/1998 | Hodgkiss | 431/73 |

OTHER PUBLICATIONS

U. S. Patent Application Serial No. 08/560,902, entitled "Gas Oven Control System", filed Nov. 20, 1995, by Joseph J. Cacciatore (HW–46).

*Primary Examiner*—Ira S. Lazarus
*Assistant Examiner*—Josiah Cocks
*Attorney, Agent, or Firm*—Mason, Kolehmainen, Rathburn & Wyss; Joan Pennington

[57] ABSTRACT

A direct spark ignition control system is provided for controlling for a gas fireplace burner. A solenoid is operatively controlled for supplying gas to the gas fireplace burner. A high voltage spark ignition circuit is operatively controlled for generating ignition sparks near the gas fireplace burner. A flame sensing circuit coupled to the gas fireplace burner provides a feedback signal to activate and deactivate the high voltage spark ignition circuit. A timing and control circuit provides a control signal to energize the solenoid and provides a control signal to deactivate the high voltage spark ignition circuit and a control signal to deenergize the solenoid after a set time period with the burner flame feedback signal activated.

13 Claims, 4 Drawing Sheets

GAS FIREPLACE BURNER CONTROL SYSTEM

FIELD OF THE INVENTION

The present invention relates to a gas burner control system, and more particularly to a gas burner control system and method for controlling a gas fireplace burner including direct spark ignition.

DESCRIPTION OF THE PRIOR ART

Various arrangements are known in the art for gas burner control. Known gas control systems typically used for controlling a furnace have been used for controlling a gas fireplace burner. Such furnace control systems generally are complicated in arrangement, including three probes with a separate probe for spark, flame sensing and ground and an AC step-down transformer. As a result such furnace control systems are expensive.

A need exists for an improved gas fireplace control system. It is desirable to provide an improved gas fireplace control system that includes direct spark ignition; and that is less expensive and a simpler arrangement, while providing effective and reliable operation.

SUMMARY OF THE INVENTION

A principal object of the present invention is provide an improved gas fireplace control system including direct spark ignition. Other important objects of the invention are to provide an improved gas fireplace control system that provides effective and reliable operation; to provide such improved gas fireplace control system that is less expensive and a simpler arrangement than known fireplace control systems; and to provide such improved gas fireplace control system overcoming one or more of the disadvantages of known fireplace control arrangements.

In brief, a direct spark ignition control system is provided for controlling for a gas fireplace burner. A solenoid is operatively controlled for supplying gas to the gas fireplace burner. A high voltage spark ignition circuit is operatively controlled for generating ignition sparks near the gas fireplace burner. A flame sensing circuit coupled to the gas fireplace burner provides a feedback signal to activate and deactivate the high voltage spark ignition circuit. A timing and control circuit provides a control signal to energize the solenoid and provides a control signal to deactivate the high voltage spark ignition circuit and a control signal to deenergize the solenoid after a set time period with the burner flame feedback signal activated.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1A:
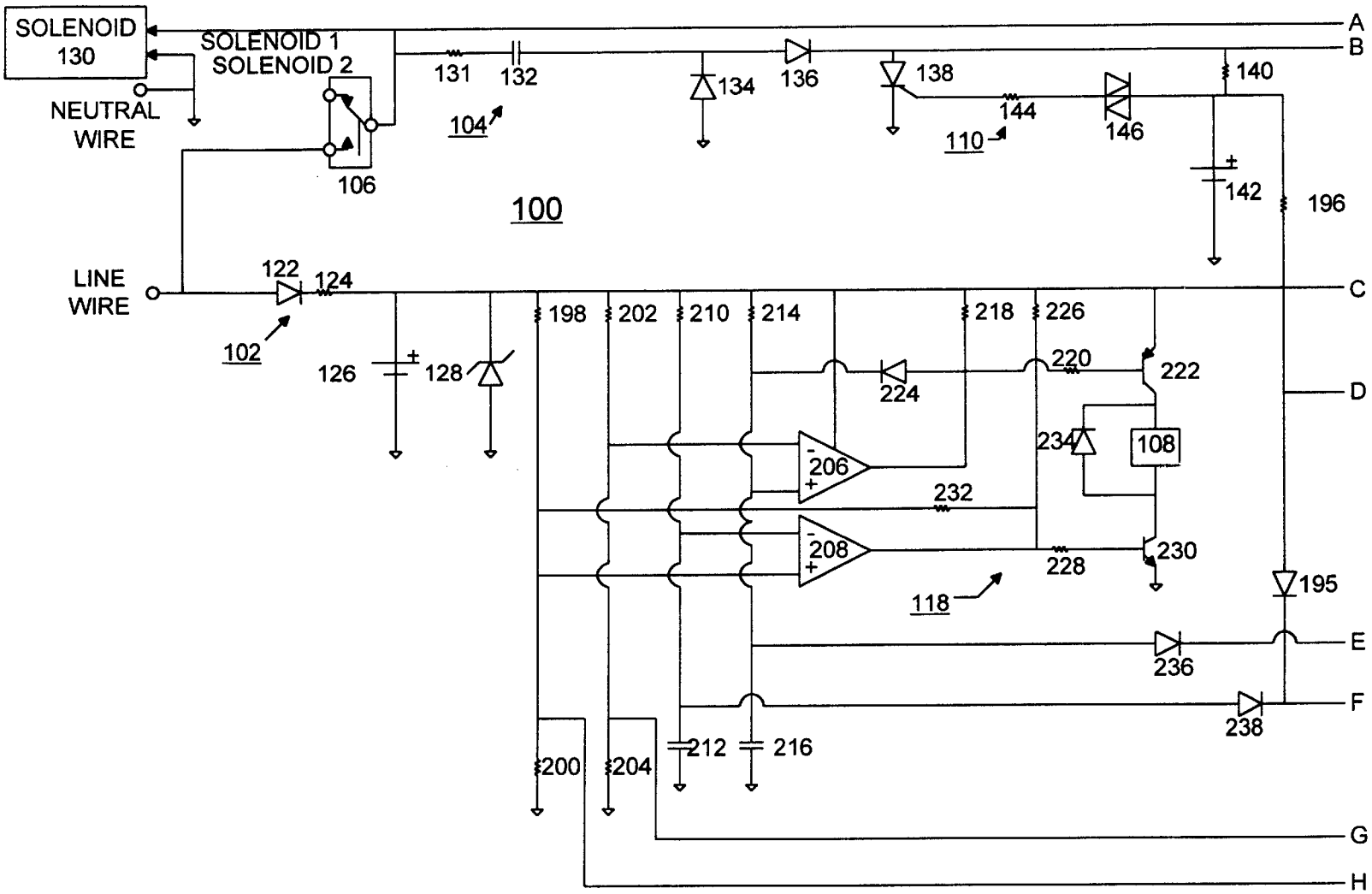
FIGS. 1A and 1B together provide a schematic and block diagram illustrating a gas fireplace control system employing direct spark ignition in accordance with the present invention.
Figure 1B:
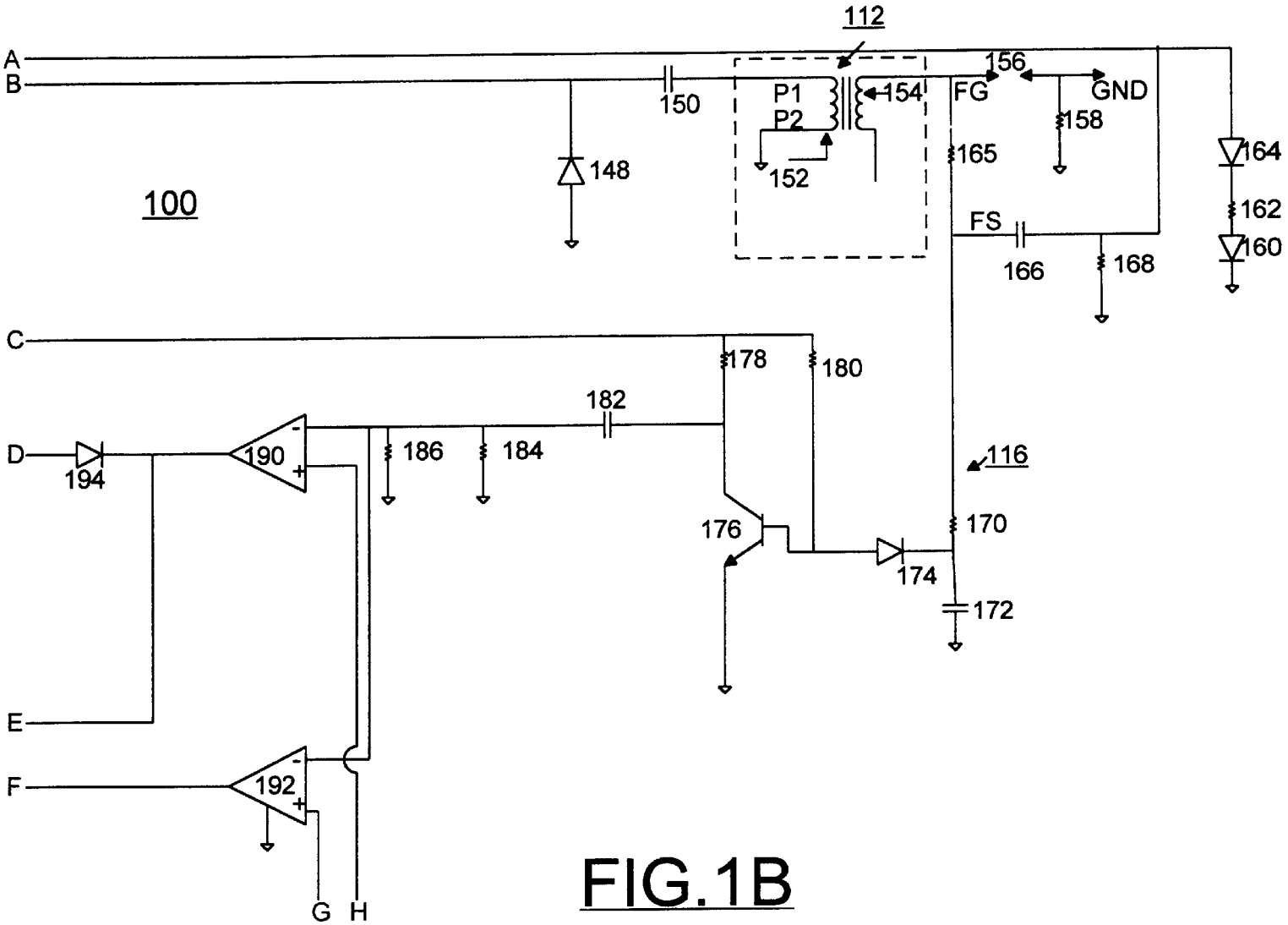

Having reference now to the drawings, in FIGS. 1A and 1B, there is shown a gas fireplace control system generally designated by 100 for implementing gas fireplace control of the invention. Gas fireplace control system 100 is an analog, fail-safe control system including among its primary components a direct current (DC) power supply 102 connected to a nominal 120 VAC 60 Hz input labeled LINE WIRE; a solenoid power supply and voltage multiplier 104 enabled by a pair of closed relay contacts 106 of a relay 108; a high voltage spark ignition circuit 110 coupled to a high voltage spark ignition transformer 112; a flame sensing spark enable circuit 116 provides a feedback signal to activate and deactivate the high voltage spark ignition circuit; and a dual analog timing and control circuit 118 that provides a control signal to energize the relay 108 and provides a control signal to deactivate the high voltage spark ignition circuit 110 and a control signal to deenergize the relay 108 after a set time period with the burner flame absent feedback signal activated.

DC power supply 102 includes a diode 122 connected to the nominal 120 VAC 60 Hz input LINE WIRE and to a series connected resistor 124, and a parallel combination of a filter capacitor 126 and a Zener diode 128 connected between ground and the resistor 124. The DC power supply 102 provides a set DC supply voltage, for example, 24 VDC at the line labeled C in FIGS. 1A and 1B. Gas is supplied to the fireplace burner by closing relay contacts 106 to supply power to a 120 VAC gas supply solenoid 130 at a line labeled A in FIGS. 1A and 1B. The 120 VAC line supply is coupled via the closed relay contacts 106 to the spark voltage multiplier circuit 104.

Spark voltage multiplier circuit 104 includes a resistor 131 series connected with a capacitor 132 and a pair of diodes 134 and 136 as shown, providing a high voltage input to a line labeled B to the spark ignition circuit 110. The spark voltage multiplier circuit 104 provides, for example, double the 120 VAC line supply input or 240 VAC at line B.

Spark ignition circuit 110 includes a silicon controlled rectifier (SCR) 138 and a resistor 140 connected to the high voltage line B. Resistor 140 is connected in series with a capacitor 142 to ground. The gate of SCR 138 is connected to a series connected resistor 144 and a DIAC 146. The DIAC 146 is connected to the junction of resistor 140 and capacitor 142. Referring to FIG. 1B, spark ignition circuit 110 includes a diode 148 connected between the high voltage line B and ground and a capacitor 150 connected to a primary winding 152 of the spark ignition transformer 112. In operation, with trigger voltage level at the junction of resistor 140 and capacitor 142, the DIAC 146 conducts, triggering the SCR 138, and capacitor 150 discharges through the primary winding 152 of the spark ignition transformer 112. The secondary winding 154 of the high voltage spark ignition transformer 112 provides ignition sparks proximate to the gas fireplace burner via a connection to one side of a spark gap 156 with the other side of the spark gap 156 connected to a resistor 158 and ground.

A light emitting diode 160 coupled via a resistor 162 and a diode 164 to the 120 VAC supply power line A to the gas supply solenoid 130 provides a visual indication that the solenoid 130 is activated. Jumpers on a high voltage circuit board 152 (FIG. 2), are indicated by P1, P2, FG and FS in FIG. 1B.

The flame sensing spark enable circuit 116 enables the spark ignition circuit 110 responsive to no flame condition and disables the spark ignition circuit 110 responsive to a flame present condition. A flame sensing signal at a line FS is coupled to a first resistor 165, a capacitor 166 series connected with a resistor 168 to ground, and a resistor 170 series connected with a capacitor 172 to ground. The nominal 120 VAC power line input is supplied at the line A. A diode 174 is connected between the junction of the series connected resistor 170 and capacitor 172 and the base of an NPN transistor 176. A pair of biasing resistors 178 and 180 are respectively connected between the DC supply line C and the collector and the base of the NPN transistor 176 with the emitter of transistor 176 connected to ground. An AC coupling capacitor 182 is connected between the collector of NPN transistor 176 and a first inverting input of a pair of first comparators 190 and 192. A pair of parallel resistors 184 and 186 are connected between the first inverting input of the first comparators 190 and 192 and ground. A respective one of a pair of diodes 194 and 195 is connected between the output of the comparitors 190 and 192 and a resistor 196 connected to the junction of resistor 140 and capacitor 142 of the spark ignition circuit 110.

A reference voltage is applied to the second non-inverting input of the comparitors 190 and 192 by a pair of series connected resistors 198, 200 and 202, 204 at a respective one of lines G and H. The pair of series connected resistors 198, 200 and 202, 204 are connected between the DC supply voltage at line C and ground. The dual analog timing and control circuit 118 includes a second pair of comparators 206 and 208. The reference voltage provided by the pair of series connected resistors 198, 200 and 202, 204 is applied respectively to a non-inverting input of comparator 208 and is applied to an inverting input of comparator 206. A respective one of a pair of resistors 210, 214 is series connected with one of a pair of capacitors 212, 216. Each of the resistor-capacitor (RC) combinations 210, 212 and 214, 216 provides a resistor-capacitor (RC) timing input applied to an inverting input of comparator 208 and applied to a non-inverting input of comparator 206. The timing capacitor 212, 216 charge to approximately ⅔ of the DC voltage supply at line C.

The output of comparator 206 is connected to a first resistor 218 connected to the DC supply voltage at line C and a second resistor 220 connected to a base of a control PNP transistor 222. The output of comparator 206 is connected to a diode 224 connected to the junction RC timing resistor 214 and capacitor 216. The output of comparator 208 is connected to a first resistor 226 connected to the DC supply voltage at line C and a second resistor 228 connected to a base of a control NPN transistor 230. The output of comparator 208 is connected to a resistor 232 connected to the junction of the series connected reference voltage resistors 198 and 200. A diode 234 is connected across the relay coil 108 connected between collectors of the PNP transistor 222 and the NPN transistor 230. The timing and control circuit 118 is connected to the output of the flame sensing circuit 116 via a pair of diodes 236 and 238. A respective one of the diodes 236 and 238 is connected between the junction of resistor 214 and capacitor 216 and the junction of resistor 210 and capacitor 212 and the output of comparator 190 at line E and the output of comparator 192 at line F.

Various commercially available components can be used within control system 100, for example, as follows. NPN transistors 176 and 230 can be provided by transistor type 2N4401 and PNP transistor 222 can be provided by transistor type 2N4403. A quad comparator integrated circuit device LM2901 can be used for the comparators 190, 192, 206 and 208. The reference voltage divider resistors 198 and 202 can be 47 KΩ with a 100 KΩ for resistors 200 and 204. The pull-up resistors 218 and 226 can be 2 KΩ. Resistors 220 and 228 can be 100 KΩ and resistor 232 can be 470 KΩ. The RC timing resistors 210 and 214 can be 240 KΩ with timing capacitors 212 and 216 of 10 microfarad. The spark ignition capacitor 150 has a value, for example of 2.2 microfarad and spark ignition capacitor 142 of 1 microfarad, resistor 140 can be 680 KΩ and resistor 144 can be 22 Ω. The capacitors 166, 172 and 182 of the flame sensing spark enable circuit can be 0.001, 0.1 and 0.1 microfarad, respectively, and resistor 165 can be a 6.8 MΩ ½ Watt rated resistor. Resistors 170, 184 and 186 can be 10 MΩ, and biasing resistors 178 and 180 can be 1 MΩ and 8.2 MΩ, respectively. A diode type 1N4006 can be used for each of the diodes 122, 134, 136, 148, 164 and 234. A diode type 1N4148 can be used for each of the diodes 194, 236 and 238.

In operation of the gas fireplace control system, the relay coil 108 is energized with comparator 206 providing a low output applied to the base of the PNP transistor 222 and comparator 208 providing a high output applied to the base of NPN transistor 224. An AC bias is provided by capacitor 166 and resistor 165 with the AC signal through capacitor 166 providing bias to the flame sensing probe FS. Capacitors 166 and capacitor 172 provide a capacitive voltage divider and DC bias via a resistor 168 and the diode 174 to the base of NPN transistor 176. The flame rectification signal from the single flame sensing probe FS in the absence of flame results in a negative charge on capacitor 172 and a bias signal being applied to the base of an NPN transistor 176 to turn on the transistor 176 to enable ignition sparks. The comparators 190 and 192 provide a high output with a low collector voltage of transistor 176 activating the spark ignition circuit 110 through diodes 194 and 195 and resistor 196 and charging capacitor 142 to start sparking. Then the capacitors 212 and 216 are discharged faster than being charged so that the timing and control circuit 118 is deactivated, removing power from the solenoid 130, and the spark ignition circuit 110 is deactivated with the outputs of comparators 190 and 192 pulled low via respective diodes 236 and 238. Then the power line input must be manually removed and reapplied to restart the control system 100.

Figure 2:
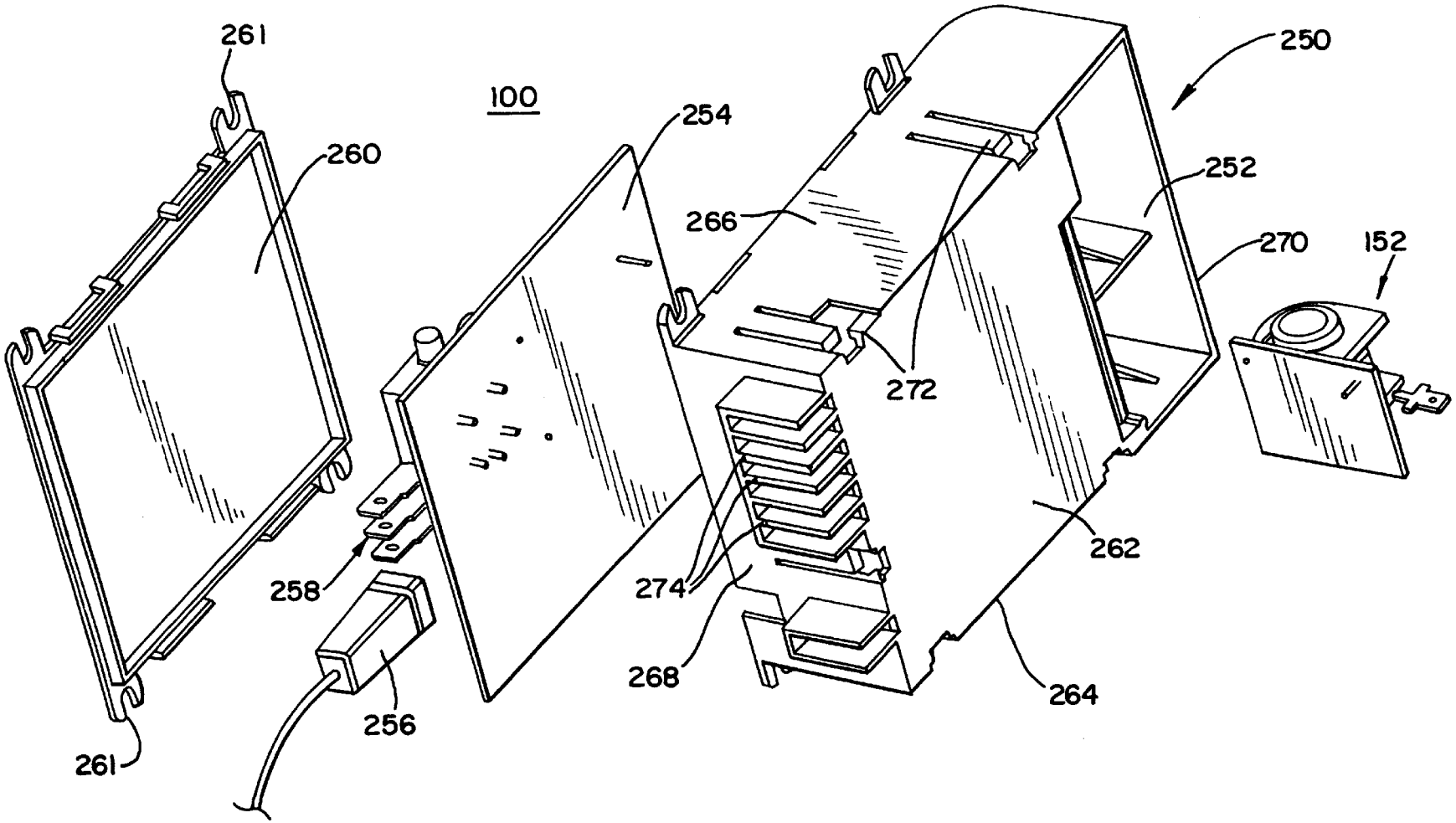
FIG. 2 is an exploded perspective view of the gas fireplace control system of FIG. 1 in accordance with the present invention.
Figure 3:
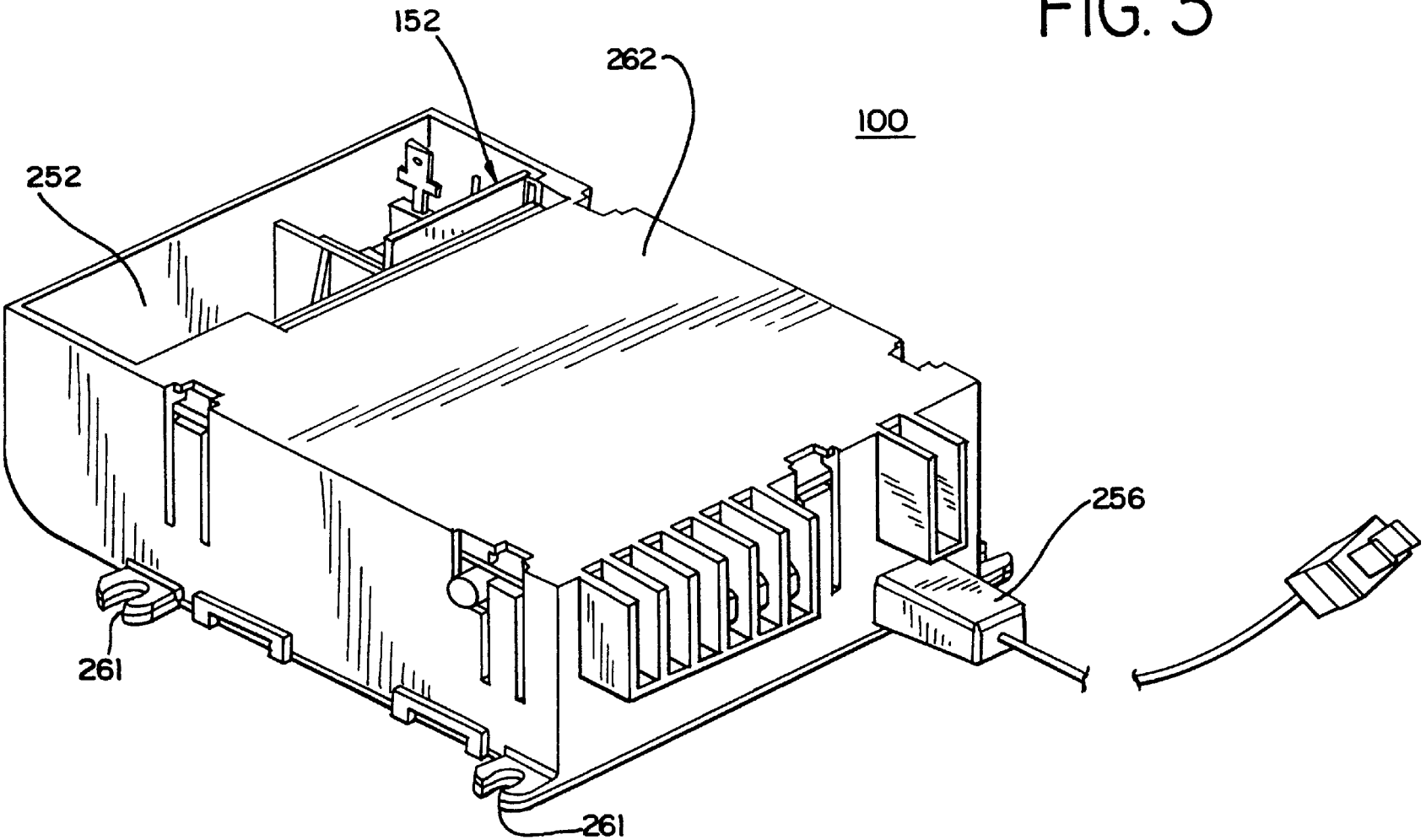
FIG. 3 is a perspective view of a gas fireplace control system constructed in accordance with the present invention.

Referring to FIGS. 2 and 3, the fireplace control system 100 includes a main housing member generally designated by the reference character 250. Housing member 250 includes a first cavity 252 for receiving the high voltage board 152. A second circuit board 254 carrying the DC power supply 102 is connected with a conventional AC power line connector 256 via terminals 258 extending from one side of the board 254. The second circuit board 254 also including the spark ignition circuit 110, the flame sensing spark enable circuit 116 and the dual analog timing and control circuit 118 is received within a separate housing cavity in the main housing member 250. A bottom wall 260 including mounting features 261 and a top wall 262 are mounted on the main housing member 250 which includes side walls 264, 266, 268, and 270 enclosing the circuit board 254. Cooperating housing features 272 are provided for mounting the top wall 262 to the housing member 250. Housing sidewall 268 includes outwardly extending shields 274 for protecting connections to system 100.

While the present invention has been described with reference to the details of the embodiments of the invention shown in the drawing, these details are not intended to limit the scope of the invention as claimed in the appended claims.

What is claimed is:

1. A fireplace control system for a gas fireplace burner comprising:

solenoid means operatively controlled for supplying gas to the gas fireplace burner;

high voltage spark ignition means operatively controlled for generating ignition sparks near the gas fireplace burner;

flame sensing means coupled to the gas fireplace burner for providing a feedback signal to activate and deactivate said high voltage spark ignition means; said flame sensing means including a bipolar transistor operatively controlled by a sensed flame signal and a first pair of comparators operatively coupled to said bipolar transistor, each of said first comparators having an output providing said feedback signal to activate and deactivate said high voltage spark ignition means;

timing and control means for providing a first control signal to energize said solenoid means and for providing a second control signal and a third control signal after a set time period with said feedback signal activated, said second control signal to deenergize said solenoid means and said third control signal to deactivate said high voltage spark ignition means; and said timing and control means including a second pair of comparators, reference voltage means providing a reference voltage to a first input of one of said second comparators and to a second input of the other of said second comparators, and resistor-capacitor (RC) timing means providing a capacitor voltage to a second input of said one of said second comparators and a first input of said other of said second comparators.

2. A fireplace control system as recited in claim 1 includes an AC power line supply input and a DC power supply coupled to said AC power line supply input.

3. A fireplace control system as recited in claim 2 further includes voltage multiplier means for multiplying said AC power line supply input and applying said voltage multiplied AC power line supply input to said high voltage spark ignition means.

4. A fireplace control system as recited in claim 3 wherein said high voltage spark ignition means operatively controlled for generating ignition sparks near the gas fireplace burner includes a spark ignition transformer.

5. A fireplace control system as recited in claim 4 further includes a capacitor coupled to a primary winding of said spark ignition transformer, said capacitor operatively controlled for discharging through said primary winding of said spark ignition transformer and a secondary winding of said spark ignition transformer for generating ignition sparks near the gas fireplace burner.

6. A fireplace control system as recited in claim 1 wherein said comparator output feedback signal is coupled to said high voltage spark ignition means through a respective diode connected to each said comparator output and a series connected resistor.

7. A fireplace control system as recited in claim 1 includes reference voltage means providing a reference voltage connected to a first input of each of said comparators and the collector of said bipolar transistor coupled to a second input of each of said comparators.

8. A fireplace control system as recited in claim 1 wherein said timing and control means include a first bipolar transistor coupled to an output of said one of said second comparators and a second bipolar transistor coupled to an output of said other of said second comparators.

9. A fireplace control system as recited in claim 8 wherein said timing and control means include a relay coil connected in series between said first bipolar transistor and said second bipolar transistor.

10. A fireplace control system as recited in claim 9 wherein said timing and control means include relay contacts operatively controlled by said relay coil for providing said first control signal to energize said solenoid means and said second control signal to deenergize said solenoid means.

11. A fireplace control system as recited in claim 9 wherein said timing and control means include a pair of diodes, each of said diodes respectively connecting said resistor-capacitor (RC) timing means capacitor voltage to said output of said first comparators.

12. A fireplace control system as recited in claim 5 further include an enclosure defining a cavity for receiving a circuit board carrying said high voltage ignition transformer.

13. A fireplace control system as recited in claim 12 wherein said enclosure include a separate cavity for receiving a circuit board carrying said flame sensing means, said timing and control means and said DC power supply.

* * * * *